US008111011B1

(12) United States Patent
Tu et al.

(10) Patent No.: US 8,111,011 B1
(45) Date of Patent: Feb. 7, 2012

(54) LED LUMINAIRE WITH IMPROVED LIFE AND OPERATION MANAGEMENT

(75) Inventors: Chin-Wang Tu, Cupertino, CA (US); Shih Chang Wang, Chung-Ho (TW); Chen-Ho Wu, Los Altos Hills, CA (US)

(73) Assignee: Leotek Electronics Corporation, Lung-Tan (TW)

( * ) Notice: Subject to any disclaimer, the term of this patent is extended or adjusted under 35 U.S.C. 154(b) by 803 days.

(21) Appl. No.: 11/972,561

(22) Filed: Jan. 10, 2008

Related U.S. Application Data

(60) Provisional application No. 60/880,374, filed on Jan. 11, 2007.

(51) Int. Cl.
*H05B 37/02* (2006.01)

(52) U.S. Cl. ..... 315/307; 315/117; 315/309

(58) Field of Classification Search ..... 315/117, 315/149, 291, 297, 307–309, 312, 360
See application file for complete search history.

(56) References Cited

U.S. PATENT DOCUMENTS

| | | | | |
|---|---|---|---|---|
| 5,734,170 | A | 3/1998 | Ikeda | |
| 6,111,739 | A * | 8/2000 | Wu et al. | 361/106 |
| 6,153,985 | A | 11/2000 | Grossman | |
| 6,583,926 | B1 | 6/2003 | Wu et al. | |
| 6,717,526 | B2 | 4/2004 | Martineau | |
| 7,019,662 | B2 | 3/2006 | Shackle | |
| 7,187,141 | B2 * | 3/2007 | Mueller et al. | 315/362 |
| 7,288,753 | B2 | 10/2007 | Cok | |
| 7,391,337 | B2 * | 6/2008 | St-Germain | 340/686.1 |
| 7,573,210 | B2 * | 8/2009 | Ashdown et al. | 315/307 |
| 2002/0171377 | A1 * | 11/2002 | Mueller et al. | 315/291 |
| 2004/0131094 | A1 | 7/2004 | Miremadi | |
| 2004/0201579 | A1 | 10/2004 | Graham | |
| 2005/0030192 | A1 | 2/2005 | Weaver et al. | |
| 2005/0200295 | A1 * | 9/2005 | Lim et al. | 315/150 |
| 2006/0016960 | A1 | 1/2006 | Morgan et al. | |
| 2006/0076908 | A1 * | 4/2006 | Morgan et al. | 315/312 |
| 2006/0097978 | A1 * | 5/2006 | Ng et al. | 345/102 |
| 2008/0129267 | A1 * | 6/2008 | Lenz | 323/285 |

OTHER PUBLICATIONS

Technical Datasheet DS25 entitled "Power Light Source LUXEON Emitter," Philips Lumineds Lighting Company, pp. 1-18, May 2007.
U.S. Appl. No. 11/481,659, filed Jul. 2006, Kashaninejad.

* cited by examiner

*Primary Examiner* — Tung X Le
(74) *Attorney, Agent, or Firm* — DLA Piper LLP (US)

(57) ABSTRACT

A method and apparatus for adjusting the drive signal of an LED luminaire is provided and includes an LED light source assembly, an ambient sensor circuit, a comparator circuit, and a driver circuit. The ambient sensor circuit provides an ambient signal to the LED light source assembly, which is a function of the ambient (such as temperature, humidity or air visibility) proximate to the LED light source assembly. The comparator circuit provides a bidirectional ambient adjustment signal to the driver circuit, which is a function of the ambient signal and a reference signal. And the driver circuit provides an adjustable drive signal to the LED light source assembly, which is a function of the bidirectional ambient adjustment signal.

8 Claims, 5 Drawing Sheets

LED LUMINAIRE WITH IMPROVED LIFE AND OPERATION MANAGEMENT

This application claims the benefit of U.S. Provisional Application No. 60/880,374, filed Jan. 11, 2007 and entitled LED Luminaire With Improved Life And Operation Management.

FIELD OF THE INVENTION

The present invention relates to adjusting the drive signals of an LED luminaire (i.e. a light fixture or unit) according to particular ambient conditions. More specifically, the present invention provides an effective drive signal management method and apparatus that optimizes the performance of LED luminaires.

BACKGROUND OF THE INVENTION

Light-Emitting Diodes (LEDs) have been used in many applications to replace conventional incandescent lamps, fluorescent lamps, Neon tube and fiber optics light sources to reduce electrical and maintenance costs and increase reliability (due to the fact that LEDs consume less electrical energy than many conventional light sources while exhibiting much longer lifetimes). Many designs have been invented for various applications, such as traffic signal lights, channel letter modules, conventional illuminated commercial signs, street signs, etc.

Heat is one of the worst enemies affecting the life of an LED device. Designs to ensure that an LED product doesn't operate at too high of a junction temperature is critical to ensure the reliability of the product. If an LED device operates at too high of a junction temperature, it can often be damaged and its life is reduced. As such, since there is usually an allowable maximum junction temperature determined by LED manufacturers, it is critical that LED devices do not operate above this maximum allowable junction temperature to avoid serious damage.

Heat is usually generated when an electrical current passes through an LED device to produce light. Consequently, the heat will raise the junction temperature of the LED device. When the junction temperature of an LED rises, the quantum efficiency of the device usually decreases. For example, the efficiency of a high power "Blue+phosphors" white LED is about 20% less at 80° C. junction temperature than at 25° C. according to the "Technical Datasheet DS25" of Philips Lumileds Lighting for their high power LED lamps, which is hereby incorporated by reference.

Since heat is continuously generated when an LED device is in operation, heat sinking arrangements are usually included in a luminaire to transfer heat from the LED devices to other parts of the luminaire, and then from these other parts of the luminaire to the surrounding environment such as air. The rate to remove heat, however, is usually slower than the rate heat is generated when the luminaire is just turned on. The temperature of the luminaire and the LED devices thus rise accordingly.

When the luminaire temperature is higher, the temperature gap between the luminaire and the environment is bigger. And when this temperature gap is bigger, the heat dissipation rate to the surrounding environment is higher. An equilibrium temperature is eventually achieved when the heat generated equals the heat dissipated between the luminaire and the surrounding environment. The equilibrium temperature is higher if the heat dissipation capability of the heat sink is lower, and vice versa.

The junction temperature of an LED device will rise accordingly too and will stay at an equilibrium junction temperature. Usually a lower operating current results in a lower equilibrium junction temperature because less heat is generated. And a lower environmental temperature results in easier heat dissipation from the luminaire to the surrounding environment LED luminaires are operated to produce light flux for lighting up a specific space, wherein a higher operating current results in more flux being produced. However when an LED is driven at a higher current it usually works less efficiently than when it's driven at a lower current. Therefore, a compromised operating current is usually chosen to get as much flux at an acceptable LED junction temperature where the LED efficacy is acceptable.

When a compromised operating current is chosen, it's desirable to operate it at or within a selected range of that current. Beyond the selected range, the luminaire will either produce less than the desired flux or operate at the risk of damaging the life of LED and luminaire.

Some luminaires such as street lights etc. are designed to operate mainly at night when the daylight has disappeared or is disappearing, and when the environmental temperature is lower at that time than at the day time. To turn on or off the light usually depends on a timer, a photo-controller to do it automatically (i.e. by detecting low light levels), or by manual switching to achieve that purpose. When a malfunction happens that these mechanisms fail to turn the light off at dawn, the luminaire could be lit up during the day time when the environmental temperature is hot, especially in the summer time. When this happens, it not only wastes electrical energy and adds unnecessary electricity burden to the power plants, but it can also damage the LED devices since they are working at a much higher environmental temperature. There can also be cases that even at night time, the temperature is high and protection of the LEDs from overheating is also necessary.

Lastly, luminaires are used in different climates and in different surroundings. traditional light sources typically provide a fixed color of light only and usually allow no choices in color once a particular lamp is installed. Changing the hue of lighting is sometimes desirable as the environment changes, for instance when fog comes in etc.

Accordingly, there is a need for a method and apparatus for providing a mechanism which can slow down the operation and the heat generation of the LED product when the temperature of the product is high enough to endanger the life of the LED product, and thus prevent it from a catastrophic breakdown. There is also a need for incorporating a design to change the hue of the lighting if the need arises.

SUMMARY OF THE INVENTION

The aforementioned problems are solved by providing a method and apparatus for efficiently managing the drive signal of an LED luminaire.

An LED luminaire apparatus includes an LED light source assembly, a temperature sensor circuit coupled to the LED light source assembly, wherein the temperature sensor circuit provides a temperature signal, and wherein the temperature signal is a function of the temperature proximate to the LED light source assembly, and a driver circuit coupled to the LED light source assembly, wherein the driver circuit provides an adjustable drive signal to the LED light source assembly that dictates luminosity and heat generated by the LED light source assembly, and wherein the adjustable drive signal increases and decreases in response to changes in the temperature signal.

In another aspect, an LED luminaire apparatus includes an LED light source assembly for producing an optical output, a humidity sensor circuit coupled to the LED light source assembly, wherein the humidity sensor circuit provides a humidity signal, and wherein the humidity signal is a function of humidity proximate to the LED light source assembly, and a driver circuit coupled to the LED light source assembly, wherein the driver circuit provides an adjustable drive signal to the LED light source assembly that dictates the luminosity generated by the LED light source assembly, and wherein the adjustable drive increases and decreases in response to changes in the humidity signal.

In yet one more aspect, a method for managing a drive signal to an LED luminaire includes sensing an ambient condition proximate to an LED light source assembly, generating an ambient signal, wherein the ambient signal is a function of the sensed ambient condition proximate to the LED light source assembly, generating an adjustable drive signal that dictates at least one of the luminosity, heat and color of light generated by the LED light source assembly, and increasing and decreasing the drive signal in response to changes in the ambient signal.

Other objects and features of the present invention will become apparent by a review of the specification, claims and appended figures.

DETAILED DESCRIPTION OF THE PREFERRED EMBODIMENTS

The present invention is directed towards adjusting the drive signals of an LED luminaire according to particular ambient conditions. For example, one objective is to provide a mechanism which can slow down the operation and heat generation of an LED product when the temperature of the product is high enough to endanger the life of the LED product. Another objective is to incorporate a design that changes the hue of the lighting as a function of humidity.

Figure 1A:
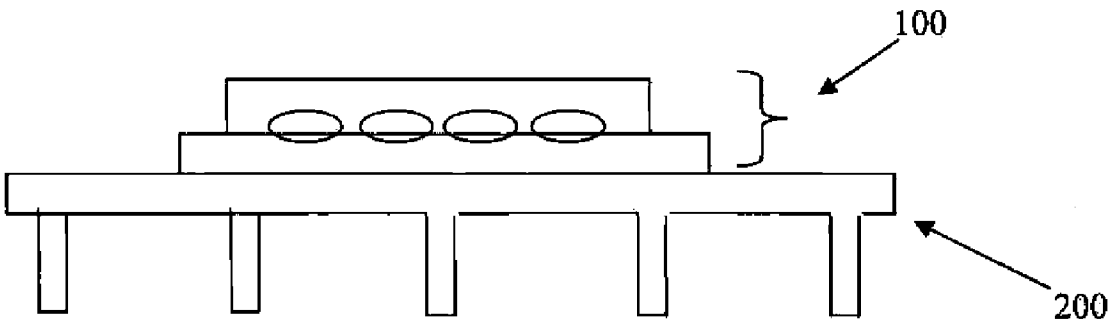
Fig. 1A (Prior Art)
FIG. 1A is a side cross sectional view of a conventional LED luminaire with multiple LEDs.
Figure 1B:
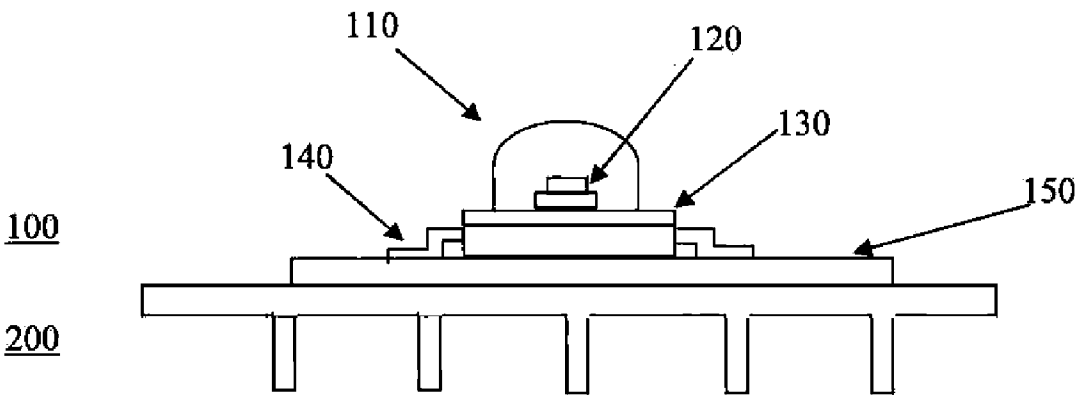
Fig. 1B (Prior Art)
FIG. 1B is a side cross sectional view of a conventional LED luminaire with a single LED.

In FIG. 1A, a side view of an LED light source assembly 100 coupled to a heat sink assembly 200 (of conventional design as shown). In FIG. 1B, a more detailed view of LED light source assembly 100 is shown, which preferably includes a LED lamp 110 having an LED 120, a slug 130, a package lead 140 (of conventional design as shown). The LED lamp 110 is mounted on a metal-core printed circuit board (MCPCB) 150.

Functionally, heat sink assembly 200 works to take away heat generated during the operation of LED light source assembly 100. When in operation, the heat generated by the LED light source assembly 100 will dissipate through slug 130, then through MCPCB 150, and then to heat sink assembly 200. Due to thermal resistance, the junction temperature $T_J$ at the junction of LED 120 is higher than the temperature $T_S$ at slug 130, and the temperature $T_S$ is higher than the temperature $T_B$ at MCPCB 150.

By monitoring $T_B$, the junction temperature $T_J$ could be reasonably estimated based on a manufacturer's provided thermal resistance value. For example, if the maximum allowed junction temperature (Tj) is 120° C. and the thermal resistance between the junction of LED 120 and MCPCB 150 is 17 C/W for multiple. LED lamps 110 mounted on MCPCB 150 and 15C/W for a single LED lamp 110, this means that the temperature difference between Tj and $T_B$ is 17 degrees and 15 degrees respectively with one watt of LED operation power. Therefore, the maximum allowable temperature at MCPCB 150 should not be more than 103° C. and 105° C. respectively for either of these two LED assemblies.

Figure 2:
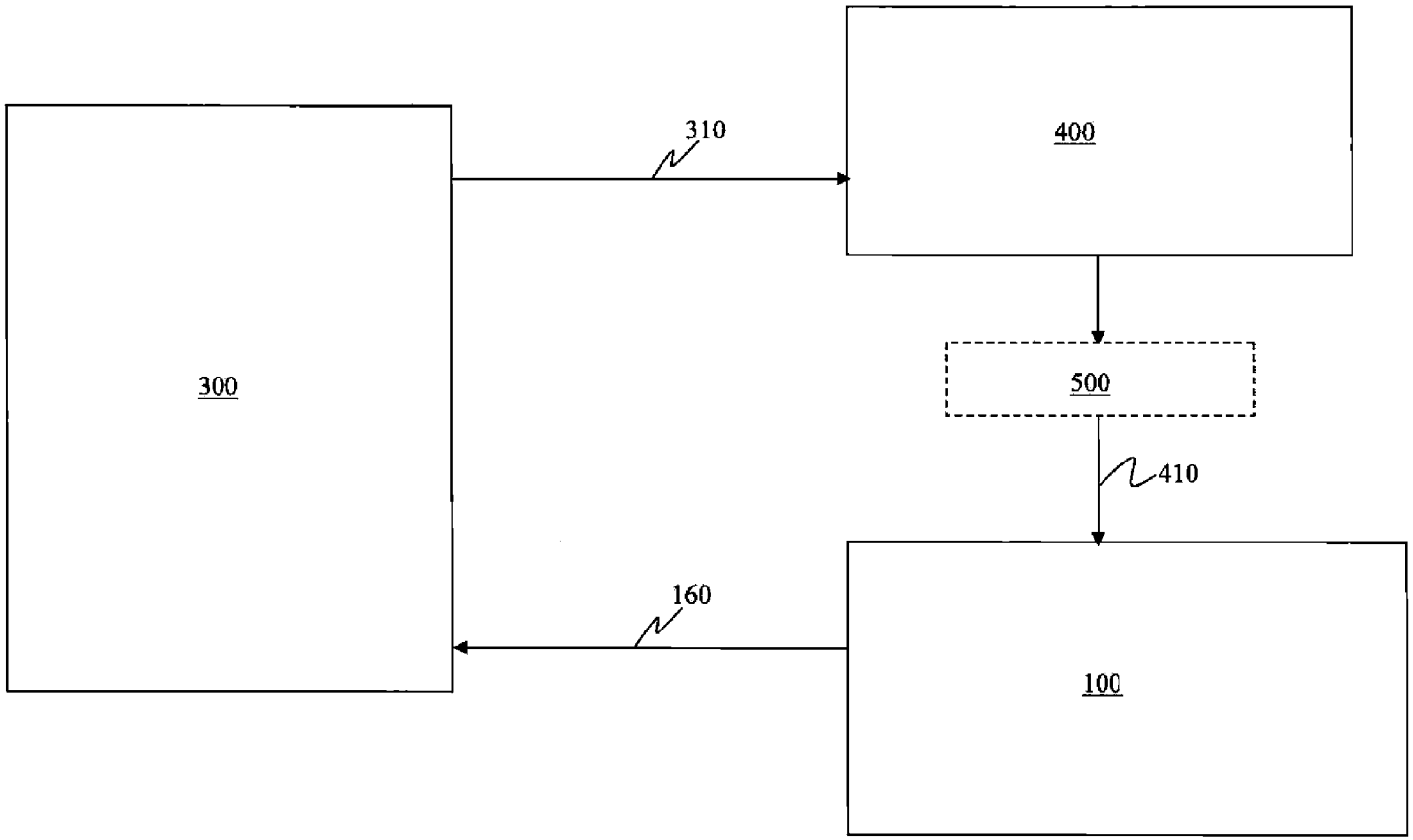
FIG. 2 is a block diagram of an LED luminaire apparatus according to an embodiment of the present invention.

In FIG. 2, a block diagram of the inventive LED luminaire apparatus is provided. In a preferred embodiment, LED light source assembly 100 is coupled to an ambient sensor circuit 300 and a switching power supply circuit 400, as shown. Within such embodiment, the ambient temperature 160 proximate to LED light source assembly 100 is sensed by ambient sensor circuit 300 (e.g. using a thermistor or thermal couple, and related circuitry), where an ambient-related signal 310 is generated and sent to power supply 400. Power supply 400 then delivers an adjustable drive signal 410 to LED light source assembly 100 to operate LEDs 100. The drive signal 410 is adjusted according to the ambient temperature 160 sensed by sensor circuit 300 as provided to power supply 400 via ambient-related signal 310.

In a further embodiment, the LED luminaire apparatus can further include a time counter circuit 500 to address the limitations of photo controllers that operate the light source based on sensed ambient light levels. Namely, when a luminaire is managed by a photo controller, the on and off time of the luminaire is often not accurately recorded, which sometimes creates a problem in managing the maintenance schedule of the luminaire and in carrying out a warranty policy. As such, the addition of time counter circuit 500 provides a solution by recording the total time that the luminaire has been in operation so as to leave no ambiguity in assessing the total on-time of the luminaire.

Figure 3:
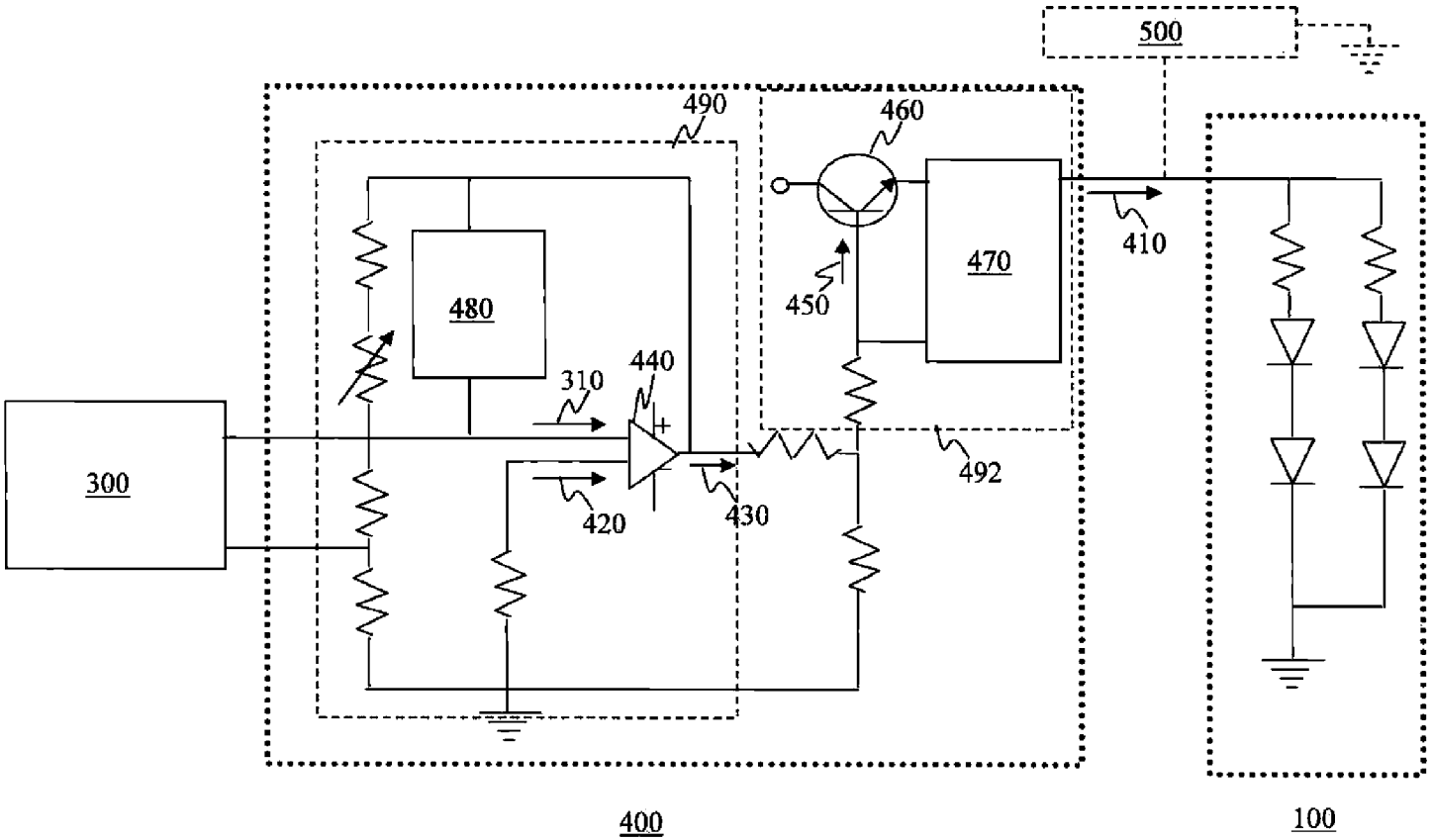
FIG. 3 is a circuit schematic of the output portion of a switching power supply for powering an LED luminaire.

In order to better appreciate the generation of drive signal 410, an exemplary circuit schematic of the output portion of power supply 400 according to a preferred embodiment is provided in FIG. 3. As illustrated, ambient signal 310 is input to comparator circuit 490 where it is compared with reference signal 420 so as to produce a bidirectional adjustment signal 430. The ambient signal 310 and reference signal 420 are input to amplifier 440, wherein the bidirectional adjustment signal 430 is fed back as an input, along with ambient signal 310, to contribute to the bidirectional adjustment signal 430. Namely, ambient signal 310 is compared to reference signal 420 so as to raise or lower bidirectional adjustment signal 430, wherein this process repeats itself until a desired bidirectional adjustment signal 430 is reached. Here, it should be appreciated that a noise filter circuit 480 is also preferably included as part of this feedback circuit, as shown.

Bidirectional adjustment signal 430 is then used to generate current 450, which is input to driver circuit 492 and output as driver signal 410. The value of current 450 determines the value of driver signal 410 generated using transistor 460 to the LED light source 100, wherein driver signal 410 is preferably either a constant current or a constant voltage produced by constant I or V circuit 470 at any given instant in time.

In the above described configuration, ambient sensor circuit 300 manages the power output from power supply 400 by sensing the temperature proximate to assembly 100. It should be appreciated that ambient sensor circuit 300 could be located at any of several selected locations in or adjacent to assembly 100. Circuit 470 can be configured, in response to the bi-directional adjustment signal, to both increase and reduce driver signal 410 in arranged steps so as to increase or reduce the heat generation in a way that does not increase or cut off the output of assembly 100 too dramatically or quickly. As a result, thermal run away (i.e. the continual increase in drive current to maintain or increase output) could be avoided, and a better life assurance to the LED device and thus the luminaire can be achieved. Moreover, once the temperature of the light source comes down to a safer range, the power supply 400 could raise the driver signal 410 to the LEDs 120 again to raise the light output of the luminaire. This characteristic is an improvement over the inventions by Wu and Chuang (U.S. Pat. No. 6,111,739, which are hereby incorporated by reference), which dealt primarily with maintaining light output at a minimum intensity, and did not address the detrimental thermal run away problem.

There are many ways to reflect the temperature of LED light assembly 100, including the use of thermal couples. In a preferred embodiment, however, a combination of single or multiple PTC (positive thermal coefficient) resistors and single or multiple NTC (negative thermal coefficient) resistors are used so as to produce desired overall temperature-resistance performance. An exemplary temperature-resistance curve is provided in FIG. 4, where a PTC resistor is put in series with an NTC resistor to illustrate the variation of the combined resistance with temperature. When the temperature gets higher, the PTC resistance gets more dominant and could go to a very high resistance quickly.

Figure 4:
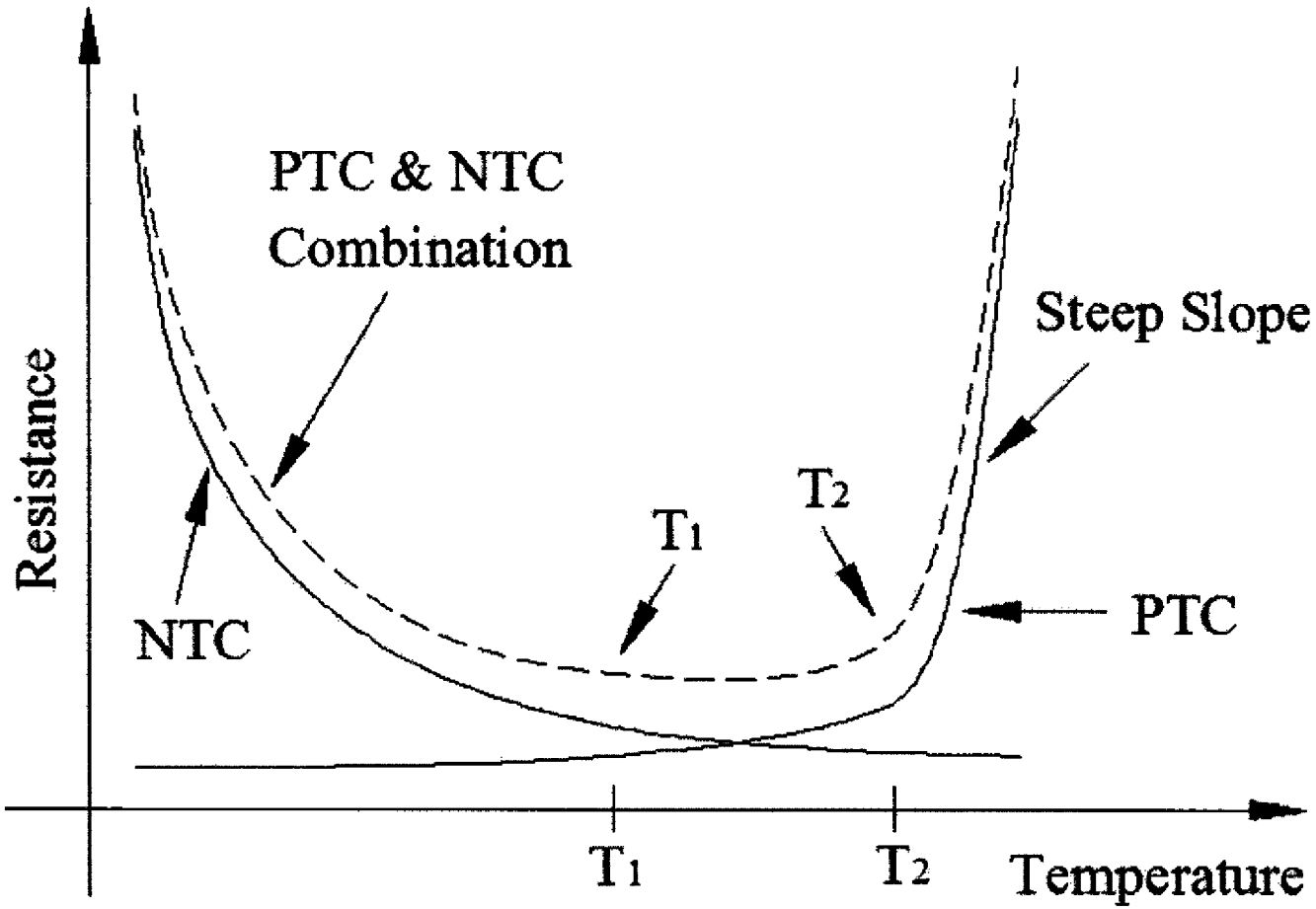
FIG. 4 is an exemplary temperature-resistance performance curve of a PTC/NTC series combination according to an embodiment of the invention.

Ideally, LED light source assembly 100 is operating at the T1 region in FIG. 4, where the combined resistance indicates normal operation. However, when the luminaire temperature goes higher and reaches the T2 region of FIG. 4, the resistance rises quickly to a very high value, indicating that a reduction in power from the power supply 400 to the LED light source 100 is needed to reduce the LED driving current 410. As a result, heat generation is reduced. If the reduction of heat is not significant enough to drop the luminaire temperature and the temperature continues to rise, the resistance will continue to increase as well, and the LED driving current 410 is further reduced. Eventually, the current 410 will become low enough that the heat generated is not enough to push the temperature any higher. The luminaire temperature will then start to drop, which prevents thermal run away. By appropriately selecting a PTC resistor with the desired resistance curve, the LED light source in a luminaire can be operated in a safer condition for better efficiency and better life time, so as to eliminate or dramatically minimize the chance of a thermal catastrophe.

In another aspect of the present invention, humidity proximate to the LED light source assembly 100 can be measured and used to adjust drive signal 410 to achieve an appropriate intensity for a particular color. For example, where fog is a concern for creating a driving hazard, a yellowish light source is often beneficial to increasing visibility. Light source assembly 100 can be configured such that its amber content in its light flux can be increased or reduced independently to increase the visibility in a foggy climate when needed. One example to achieve this is to incorporate Red, Green, and Blue LEDs 120 in light source assembly 100, where the combination of the red, green, and blue intensity is adjusted to increase the yellow content of the light (e.g. by increasing the red and green flux). Another example to achieve increased amber light is by simply adding amber LEDs to the LED light source assembly 100. The fog sensor could be added to the individual LED luminaire or to a group of luminaires to decide when and how the yellowish content of the luminaire light is to be adjusted.

Figure 5:
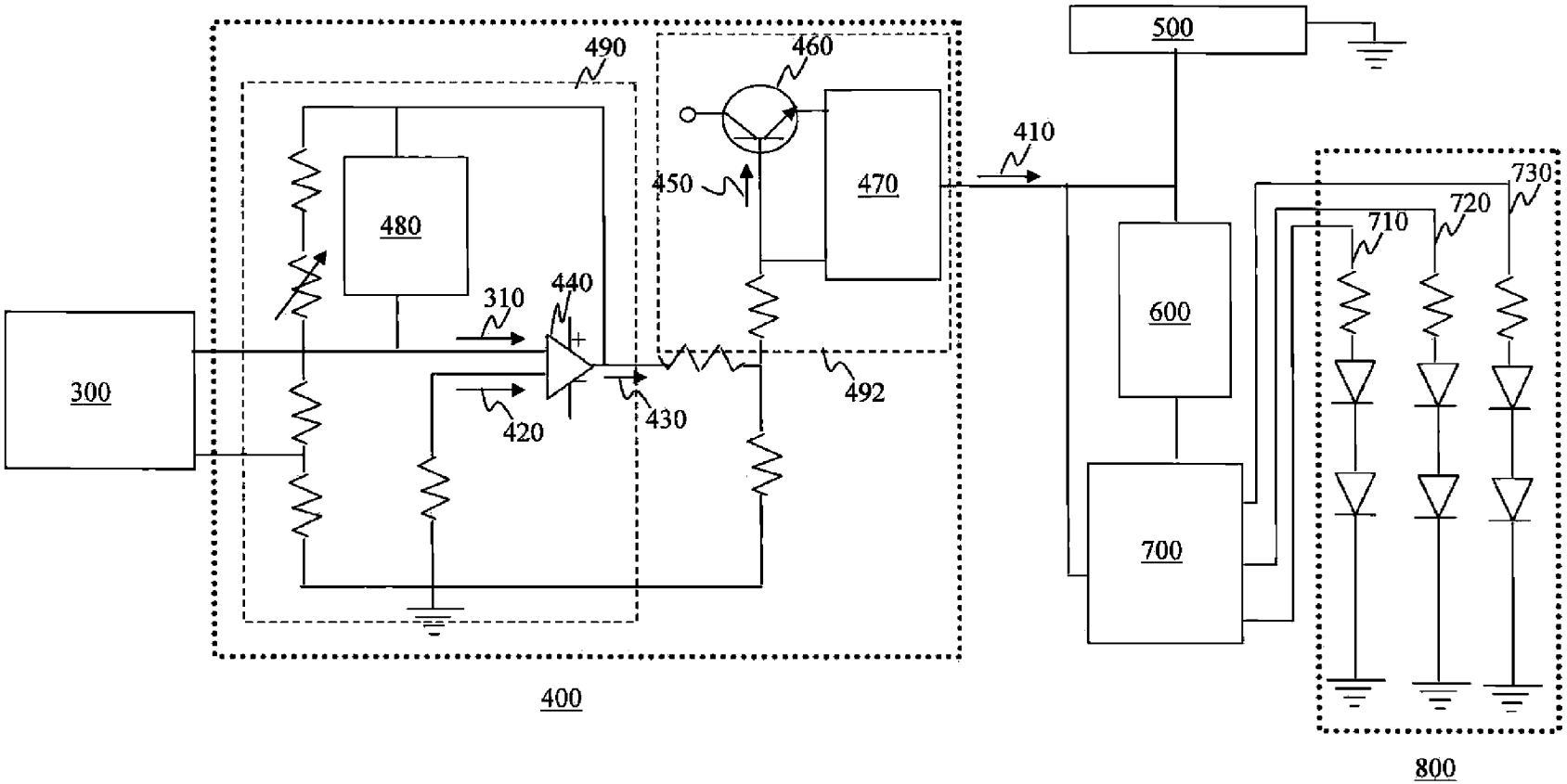
FIG. 5 is a circuit schematic of the output portion of an alternate embodiment of a switching power for powering an LED luminaire.

FIG. 5 is a schematic diagram illustrating the use of a fog sensor 600 associated with an RGB current controller 700 to LED light source 800, wherein RGB controller 700 produces signals 710, 720, and 730 to drive multiple LEDs in LED light source 800. Fog sensor 600 can be configured to detect the presence of fog through the detection of very high humidity or moisture content in the air, and/or the detection of visibility impairing water molecules in the air.

It is to be understood that the present invention is not limited to the embodiment(s) described above and illustrated herein, but encompass any and all variations falling within the scope of the appended claims. For example, any element or combination from one embodiment can be incorporated in any other embodiment or combination.

What is claimed is:

1. An LED luminaire apparatus, comprising:

an LED light source assembly for producing an optical output;

a humidity sensor circuit coupled to the LED light source assembly, wherein the humidity sensor circuit provides a humidity signal, and wherein the humidity signal is a function of humidity proximate to the LED light source assembly; and a driver circuit coupled to the LED light source assembly, wherein the driver circuit provides an adjustable drive signal to the LED light source assembly that dictates a yellow color content of the optical output generated by the LED light source assembly, and wherein the driver circuit is configured to adjust the drive signal to increase the yellow color content as the humidity proximate the LED light source assembly increases, and to decrease the yellow color content as the humidity proximate the LED light source decreases; and a comparator circuit coupled to the humidity sensor circuit and the driver circuit, wherein the comparator circuit provides a bidirectional amber adjustment signal which is a function of a comparison between the humidity signal and a reference signal of known value, and wherein the bidirectional amber adjustment signal is received by the driver circuit.

2. The apparatus of claim 1 further comprising:

a time counter circuit for monitoring the adjustable drive signal so as to provide a temporal signal that is a function of a total length of time the adjustable drive signal has been provided to the LED light source assembly.

3. The apparatus of claim 1, wherein the LED light source assembly comprises a plurality of red, green, and blue LEDs, and wherein a combination of red, green and blue intensities therefrom forms the optical output and is adjusted in response to changes in the drive signal to increase and decrease the yellow content thereof.

4. The apparatus of claim 3 further comprising:

an RGB controller, wherein the adjustable drive signal is routed to the plurality of red, green, and blue LEDS via the RGB controller.

5. The apparatus of claim 1, wherein the LED light source assembly comprises a plurality of amber LEDs for providing an increased yellow color in the optical output in response to the drive signal as the humidity proximate the LED light source assembly increases, and a decreased yellow color in the optical output in response to the drive signal as the humidity proximate the LED light source decreases.

6. A method of managing a drive signal to an LED luminaire, comprising:

sensing humidity proximate to an LED light source assembly using a humidity sensor circuit;

generating a humidity signal that is a function of the sensed humidity proximate to the LED light source assembly using a comparator circuit that provides a bidirectional amber adjustment signal which is a function of a comparison between the humidity signal and a reference signal of known value;

generating an adjustable drive signal that dictates a yellow color content of an optical output of the LED light source assembly; and adjusting the drive signal in response to changes in the humidity signal to increase the yellow color content as the humidity proximate the LED light source assembly increases, and to decrease the yellow color content as the humidity proximate the LED light source decreases.

7. The method of claim 6, wherein the LED light source assembly comprises a plurality of red, green, and blue LEDs, and wherein the increasing and decreasing of the adjustable drive signal changes the yellow color content of the optical output from the LED light source assembly.

8. The method of claim 6, wherein the LED light source assembly comprises a plurality of amber LEDs, and wherein the increasing and decreasing of the adjustable drive signal changes the luminosity of the amber LEDs.

* * * * *